US007913850B2

(12) United States Patent
Schütz

(10) Patent No.: US 7,913,850 B2
(45) Date of Patent: Mar. 29, 2011

(54) TRANSPORT AND STORAGE CONTAINER FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 112 days.

(21) Appl. No.: 12/378,282

(22) Filed: Feb. 12, 2009

(65) Prior Publication Data

US 2009/0223848 A1 Sep. 10, 2009

(30) Foreign Application Priority Data

Feb. 15, 2008 (DE) ..... 10 2008 009 327

(51) Int. Cl.
*B65D 19/00* (2006.01)

(52) U.S. Cl. ..... 206/600; 220/23.87; 220/485; 220/495; 220/625

(58) Field of Classification Search ..... 206/386, 206/599, 600; 108/55.1, 53.1, 55.3, 57.25, 108/57.28; 220/1.5, 1.6, 9.4, 23.9, 592.21, 220/23.87, 485, 495, 625
See application file for complete search history.

(56) References Cited

U.S. PATENT DOCUMENTS 5,316,174 A * 5/1994 Schutz ..... 206/386
5,358,137 A * 10/1994 Shuert et al. ..... 206/600
5,429,236 A * 7/1995 Evans ..... 206/386
6,668,735 B2 * 12/2003 Cassina ..... 108/57.25

FOREIGN PATENT DOCUMENTS

DE 101 10 926 1/2005

* cited by examiner

*Primary Examiner* — Luan K Bui
(74) *Attorney, Agent, or Firm* — Lucas & Mercanti, LLP; Klaus P. Stoffel

(57) ABSTRACT

A transport and storage container for liquids includes an inner container of plastic material with a closable filling socket and a draining socket for connection to a removal fitting, an outer casing of metal mesh or sheet metal, and an underframe constructed as a skid pallet or frame pallet which is configured to be manipulated by a lifting truck, a shelf operating device, or similar transport device. The skid pallet being equipped with a bottom resting with support legs on a metal skid and two outer skids for supporting the inner container, and the frame pallet being equipped with a base frame and support legs for the bottom. The bottom of the underframe is an injection molded article of plastic material provided with longitudinal and transverse corrugations serving as a support for the inner container and for stiffening the bottom.

8 Claims, 5 Drawing Sheets

TRANSPORT AND STORAGE CONTAINER FOR LIQUIDS

BACKGROUND OF THE INVENTION

1. Field of the Invention

The present invention relates to a transport and storage container for liquids. The container includes an inner container of plastic material with a closable filling socket and a draining socket for connection to a removal fitting, an outer casing of metal mesh or sheet metal and an underframe constructed as a skid pallet or frame pallet which is configured to be manipulated by a lifting truck, a shelf operating device, or similar transport device, and wherein the skid pallet is equipped with a bottom resting with support legs on a metal skid and two outer skids for supporting the inner container, and the frame pallet is equipped with a base frame and support legs for the bottom.

2. Description of the Related Art

A transport and storage container for liquids of the type described in DE 101 10 926 B4 is equipped with an underframe which is constructed as a pallet with skids which include a center skid and two outer skids of plastic material and a bottom of sheet metal resting on the support legs of the skids, wherein the inner container of plastic material of the transport container for receiving liquids is placed on the bottom of sheet metal.

Offered on the market are also transport containers for liquids which are equipped with a pallet of wood for supporting the inner container which is enclosed by a casing of sheet metal or a grate.

The empty weight of this known transport and storage container for liquids is relatively high.

SUMMARY OF THE INVENTION

Therefore, it is the object of the present invention to further develop the transport and storage container for liquids of the above-described type with respect to a higher stability and a reduction of the empty weight of the container.

In accordance with the present invention, the bottom of the underframe is constructed as an injection molded article of plastic material and is provided with longitudinal and transverse corrugations serving as a support for the inner container and for stiffening the bottom.

The construction of longitudinal and transverse corrugations in the bottom of the underframe of the container constructed as an injection molded article contributes to a substantial improvement of the stability of the bottom and, thus, to a high transport safety of the container. Because of the improved stability of the bottom, the thickness of the material of the bottom can be reduced. These features make it possible to reduce the empty weight and the transport costs of the container. The reduced material thickness of the underframe bottom of plastic material and the possibility of using recycled plastic material for manufacturing the bottom contribute to a reduction of the manufacturing costs of the container. The plastic material of the bottom ensures a better resistance to aggressive liquids, such as acids and lyes. By lowering and flattening the bottom which serves for supporting the inner container of plastic material of the underframe constructed as a skid pallet, an increase of the nominal volume of the container which is manufactured with different volumes with equal outer dimensions as compared to the standard containers offered on the market, without impairing the available free space for the supporting bottom of the underframe for the inner container of the transport and storage container which is necessary for the manipulation of the transport and storage container by means of a transporting device.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
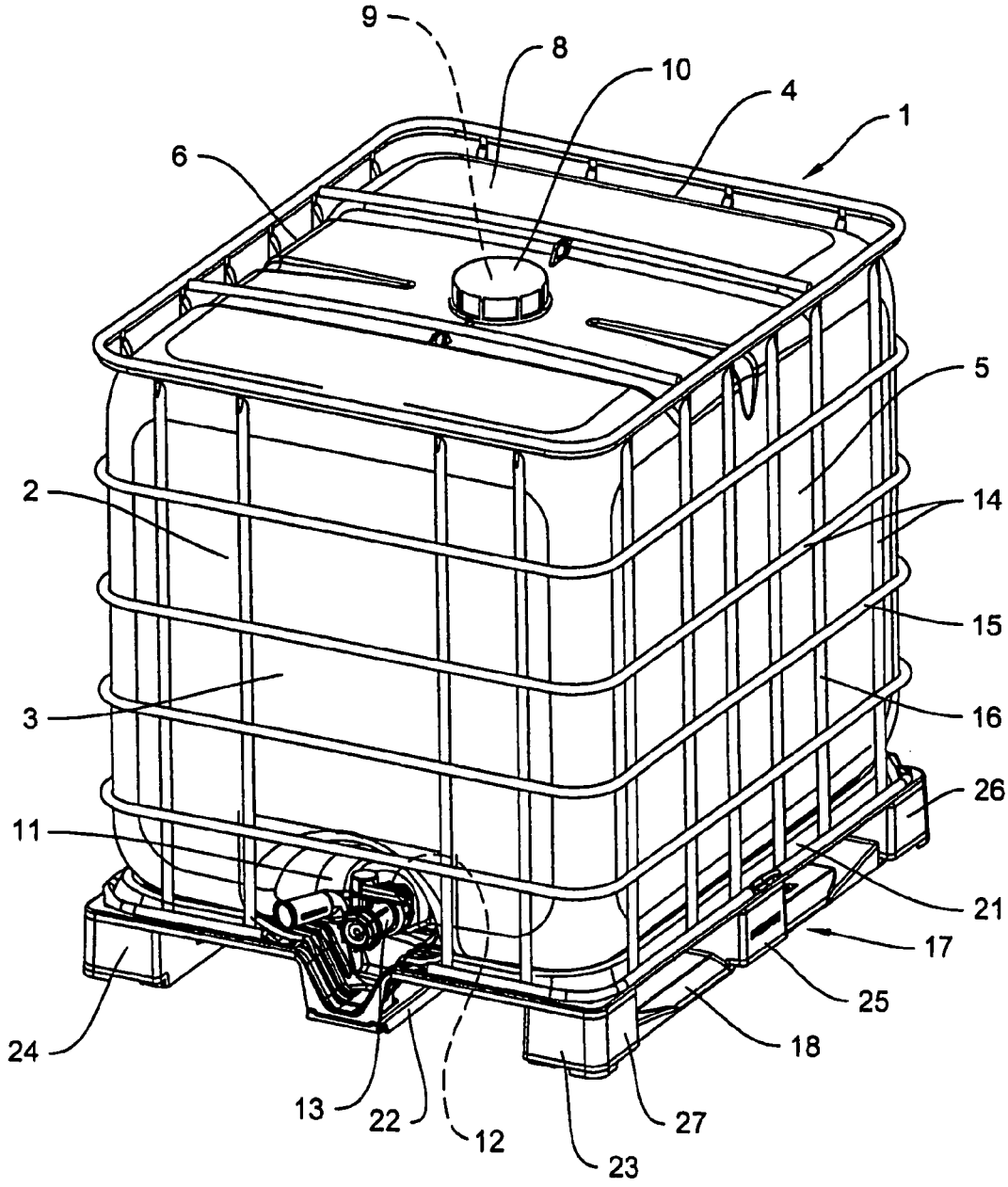
FIG. 1 is a perspective view of a transport and storage container for liquids with an underframe constructed as a pallet with skids.
Figure 2:
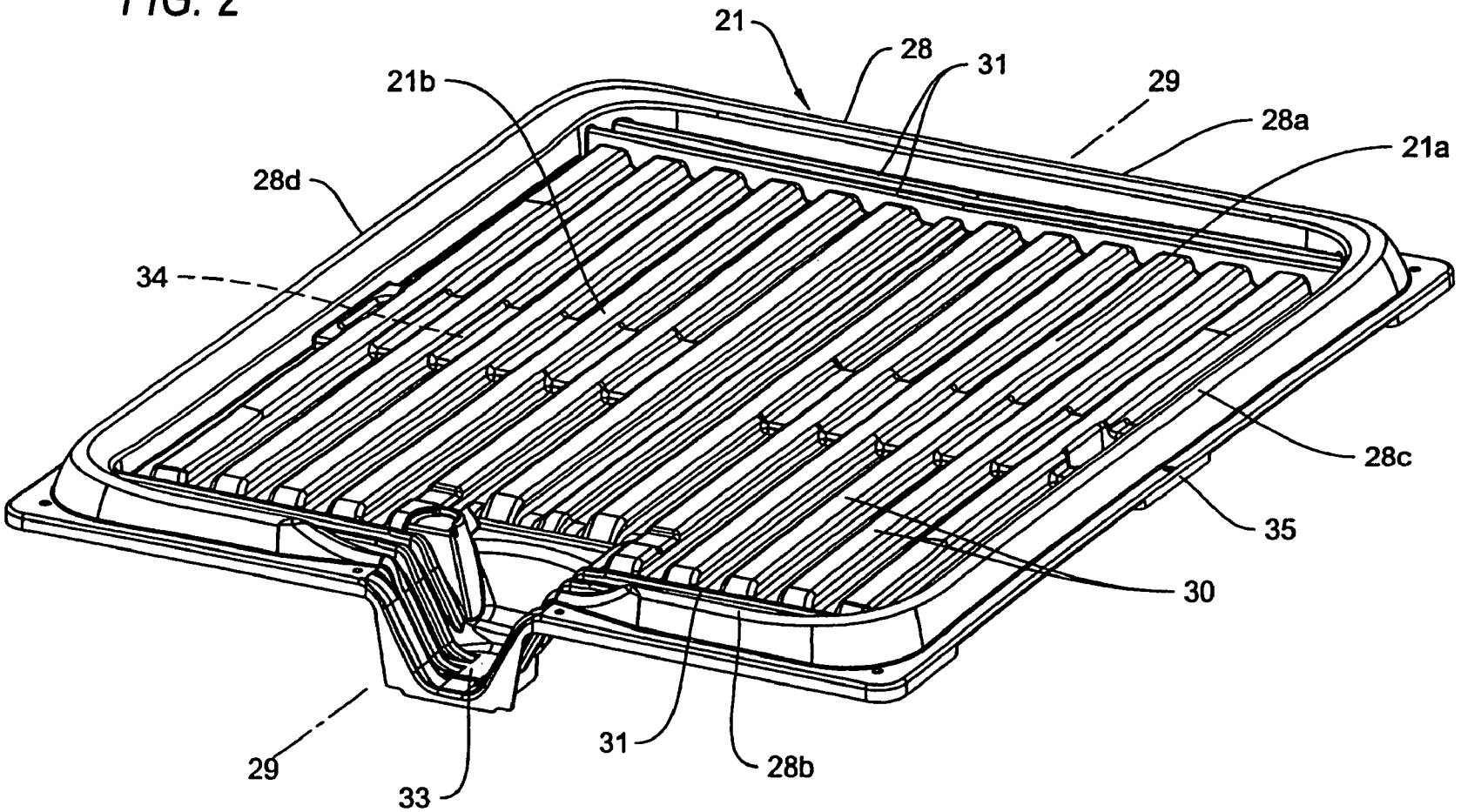
FIG. 2 is a perspective view of the bottom of the underframe of the container.
Figure 3:
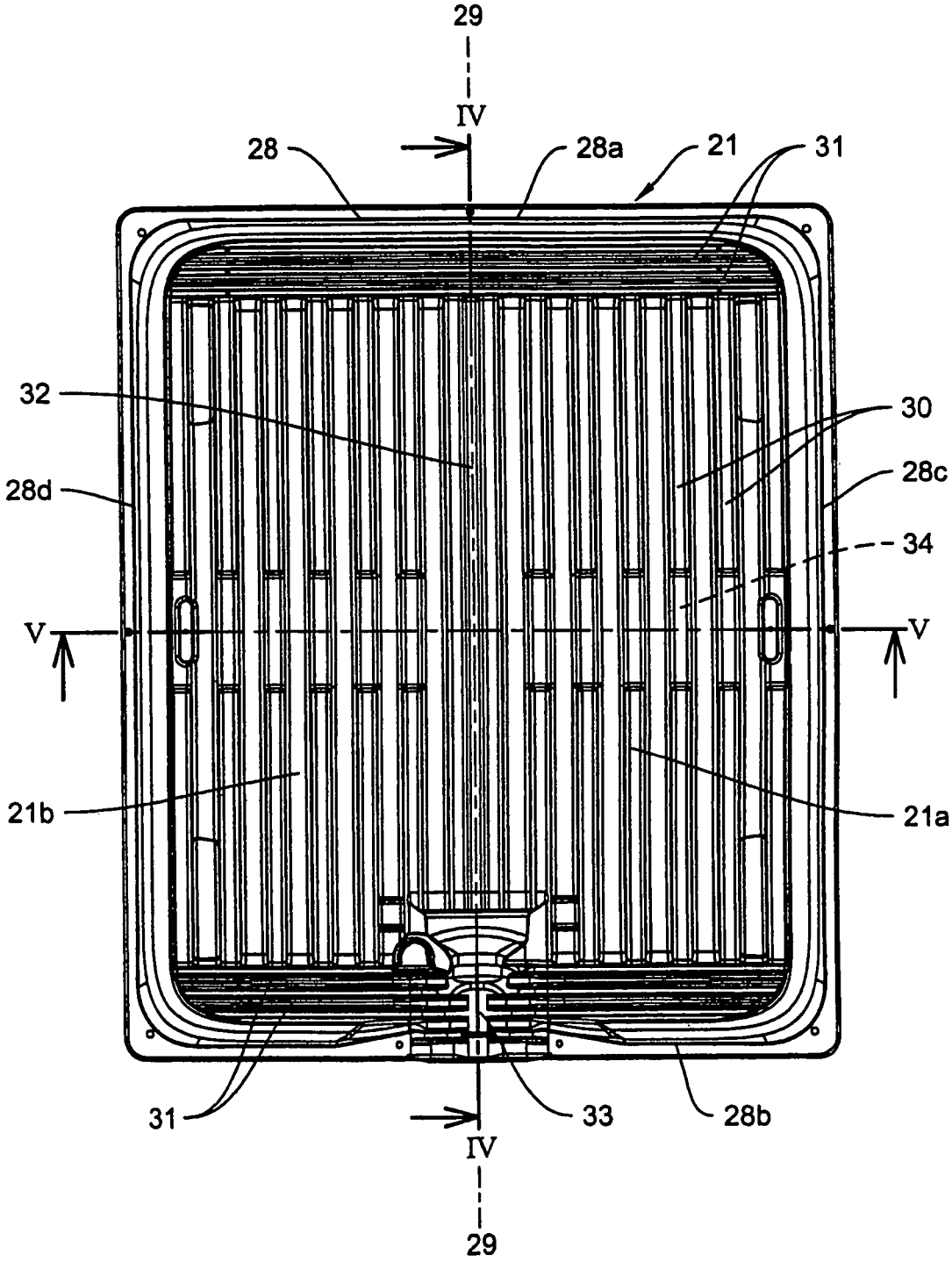
FIG. 3 is a top view of the bottom of the underframe.
Figure 4:
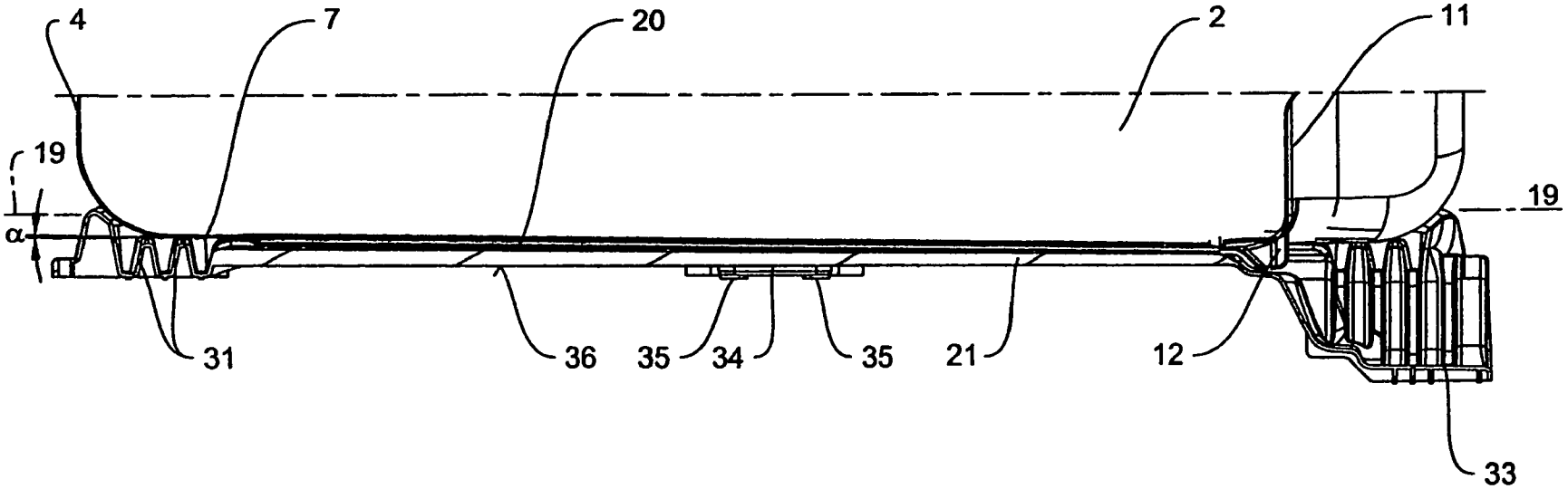
FIG. 4 is a center sectional view of the underframe bottom with a partial illustration of the inner container resting on the underframe bottom, taken along sectional line IV-IV in FIG. 3.
Figure 5:
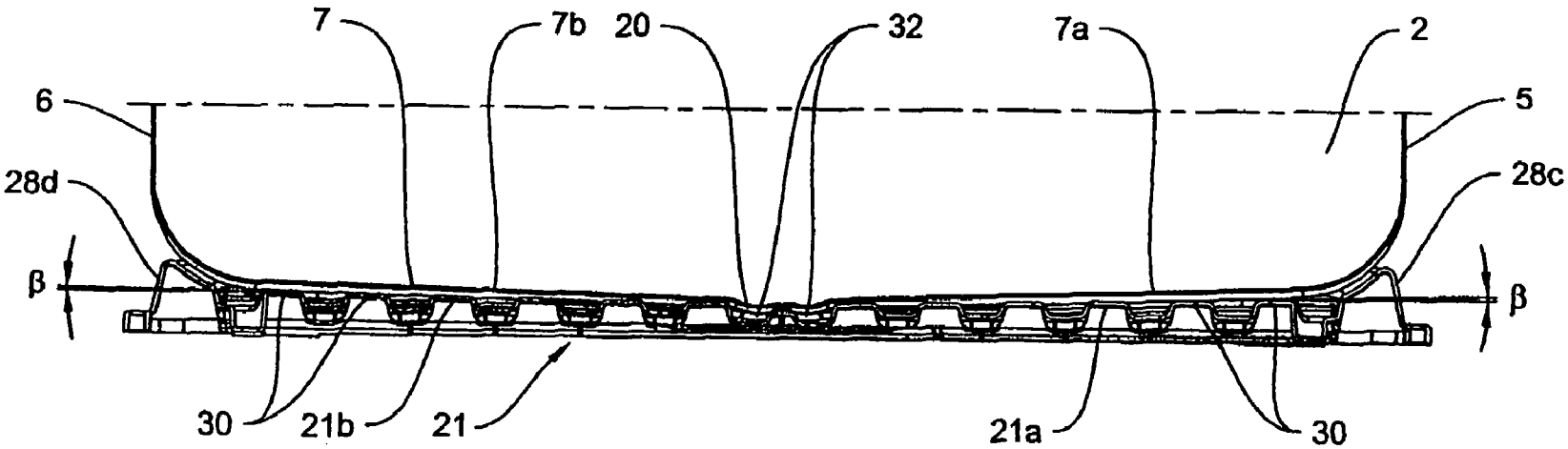
FIG. 5 is a center sectional view of the underframe bottom with a partial illustration of the inner container, taken along sectional line V-V in FIG. 3.

The transport and storage container 1 for liquids according to FIG. 1 which can be used as a single-use or multiple-use container has as its principal components an exchangeable parallelepiped-shaped inner container 2 of plastic material with a front wall 3, a rear wall 4 and two side walls 5, 6, a lower and an upper bottom 7 and 8, a filling socket 9 integrally formed on the upper bottom 8 and closable by means of a cover 10, and a discharge socket 12 to be connected to a discharge fitting 13. The container further includes an outer casing 14 constructed as a grate casing with intersecting horizontal and vertical grate rods 15, 16 of metal for receiving the inner container 2, and an underframe 17 constructed as a pallet 18 with skids having length and width dimensions in accordance with European standards. The inner container 2 rests on the underframe 17.

The lower bottom 7 of the inner container 2 constructed as a draining bottom is divided into two bottom portions 7*a*, 7*b* which are arranged symmetrically relative to the center axis of the bottom 19-19, wherein the bottom portions 7*a*, 7*b* are inclined at a flat angle of inclination $\alpha$ within the range of 2° to 5° from the rear wall 4 toward the front wall 3 of the container, and wherein the bottom portions 7*a*, 7*b* are inclined from the two side walls 5, 6 of the container 2 at a flat angle of inclination $\beta$ in the range of 2° to 5° toward the center axis 19-19 of the bottom.

The bottom 7 of the inner container 2 has a central flat discharge groove 20 which extends at a slight incline from the rear wall 4 of the container to the drain socket 12 arranged at the front wall 3 of the container for connection to the discharge fitting 13.

The skid pallet 18 of the underframe 17 of the transport and storage container 1 is composed of a bottom 21 constructed as an injection molded article of plastic material for supporting the inner container 2 and a middle skid 22 and two outer skids 23, 24 of plastic material, wherein the middle skid 22 has a middle support leg 25 and a rear support leg 26, and the two outer skids 23 and 24 each have a front, a middle and a rear support leg 27, 25, 26, respectively, for supporting the bottom 21 which has the shape of a flat tub, and wherein the gripping arms of a lifting truck, a shelf operating device or similar transport device can be moved underneath the bottom 21.

The bottom 21 of the underframe 17 adapted to the bottom 7 of the inner container 2 has an upwardly arched circumferential rim 28 and is divided into two bottom sections 21*a*, 21*b* arranged symmetrically relative to the center axis of the ground 29-29, wherein the bottom portions 21*a*, 21*b* are inclined under a flat angle of inclination $\alpha$ in the range of 2° to 5° from the rear edge section 28*a* to the front rim section 28*b* and under an angle of inclination $\beta$ in the range of 2° to 5° from the two lateral rim sections 28*c*, 28*d* to the center axis 29-29 of the bottom.

The two sections 21*a*, 21*b* of the bottom 21 of the underframe 17 have longitudinal and transverse corrugations 30, 31 as a support for the inner container 2 and for stiffening the bottom, wherein the transverse corrugations 31 are arranged in the area of the rear edge section 21*a* and the front edge section 28*b* of the bottom edge 28.

A central middle indentation 32 provided between two longitudinal corrugations 30, 30 of the bottom 21 are formed for receiving the discharge groove 20 of the lower bottom 7 of the inner container 2, wherein the indentation 32 is slightly inclined from the rear edge section 28*a* to the front edge section 28*b* of the bottom tub 28.

The bottom 21 of the underframe 17 has in the draining area underneath the draining fitting 13 of the inner container 2 a trough-like indentation 33 which is open toward the front and which forms a front support leg with a U-shaped cross-sectional profile, whereon the bottom 21 rests on the center skid 22 of the underframe 17 with the front support leg.

The bottom 21 of the underframe 17 is provided with a central stiffening sheet 34 which is directed parallel to the transverse corrugations 31 of the bottom and is placed in supports 35 on the bottom side 36 of the two bottom sections 21*a*, 21*b*.

The bottom 21 of the underframe 17 and the grate casing 14 of the transport and storage container 1 are screwed and/or welded to the support legs 25-27 of the middle skid 22 and the two outer skids 23, 24.

In accordance with another embodiment of the transport and storage container for liquids, the underframe may be constructed as a frame pallet.

While specific embodiments of the invention have been shown and described in detail to illustrate the inventive principles, it will be understood that the invention may be embodied otherwise without departing from such principles.

The invention claimed is:

1. A transport and storage container for liquids, comprising: an inner container of plastic material with a closable filling socket and a draining socket for connection to a removal fitting; an outer casing of metal mesh or sheet metal; and an underframe constructed as a skid pallet, the skid pallet having a bottom resting with support legs on a middle skid and two outer skids for supporting the inner container, wherein the bottom of the pallet is an injection molded article of plastic material provided with longitudinal and transverse ridges formed as protuberances of the bottom material and serving as a support for the inner container and for stiffening the bottom.

2. The container according to claim 1, wherein the bottom of the pallet conforms to the bottom of the inner container and has an upwardly arched circumferential rim and two bottom portions arranged symmetrically relative to the center axis of the bottom, wherein the bottom portions are inclined at an angle of inclination in the range of 2 to 5° from a rear rim section toward a front rim section of the pallet bottom and at an angle of inclination in a range of 2 to 5° from the two lateral rim sections of the bottom toward the center axis of the bottom.

3. The container according to claim 2, comprising transverse webs arranged in an area of the rear and of the front rim portions of the bottom of the pallet.

4. The container according to claim 2, comprising a central, groove-like indentation formed between two longitudinal ridges of the bottom of the pallet for receiving a discharge groove of the bottom of the inner container, wherein the discharge groove has a flat inclination from a rear rim portion toward a front rim portion of a bottom rim.

5. The container according to claim 1, wherein the bottom of the pallet has in a discharge area thereof underneath a discharge fitting of the inner container a trough-like indentation which is frontally open, wherein the indentation forms a front support leg with a U-shaped cross-section profile, wherein the bottom of the pallet rests with the front support leg on the middle skid of the pallet, wherein the bottom of the pallet additionally rests on a middle support leg and a rear support leg of the middle skid and a front support leg, a middle support leg and a rear support leg of the two outer skids.

6. The container according to claim 2, wherein a central stiffening sheet aligned parallel to the transverse ridges is mounted on an underside of the two of the portions of the bottom of the pallet.

7. The container according to claim 6, wherein supports for the stiffening sheet are mounted on the underside of the two bottom portions.

8. The container according to claim 5, wherein the bottom of the pallet and the outer casing are screwed and/or welded to the support legs of the middle skid and two outer skids.

* * * * *